US007644448B2

(12) United States Patent
Grilliot et al.

(10) Patent No.: US 7,644,448 B2
(45) **Date of Patent: *Jan. 12, 2010**

(54) PROTECTIVE GLOVE HAVING INSPECTION PORT

(75) Inventors: William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/348,680

(22) Filed: Feb. 7, 2006

(65) Prior Publication Data

US 2007/0192930 A1 Aug. 23, 2007

(51) Int. Cl.
*A41D 19/00* (2006.01)

(52) U.S. Cl. ..... 2/161.6

(58) Field of Classification Search ..... 2/161.6, 2/160, 162, 164

See application file for complete search history.

(56) References Cited

U.S. PATENT DOCUMENTS

| | | | | | |
|---|---|---|---|---|---|
| 1,970,081 | A * | 8/1934 | Eisendrath | 126/204 |
| 3,649,966 | A * | 3/1972 | Shields | 2/159 |
| 4,387,838 | A * | 6/1983 | Jackson | 224/170 |
| 4,615,049 | A * | 10/1986 | Samelian | 2/163 |
| 4,662,006 | A * | 5/1987 | Ross, Jr. | 2/158 |
| 4,679,257 | A * | 7/1987 | Town | 2/164 |
| 4,791,683 | A * | 12/1988 | Agee | 2/161.8 |
| 4,805,242 | A * | 2/1989 | Bolton | 2/160 |
| 4,805,338 | A * | 2/1989 | Schublom | 43/25 |
| 5,437,621 | A * | 8/1995 | Andrews et al. | 602/42 |
| 5,444,874 | A * | 8/1995 | Samelian et al. | 2/159 |
| 5,542,125 | A * | 8/1996 | Zuckerwar | 2/158 |
| 5,655,222 | A * | 8/1997 | Grilliot et al. | 2/81 |
| 7,086,093 | B2 * | 8/2006 | Carey et al. | 2/159 |
| 2004/0244090 | A1 * | 12/2004 | Langer | 2/160 |
| 2007/0266474 | A1 * | 11/2007 | Grilliot et al. | 2/159 |

OTHER PUBLICATIONS

U.S. Appl. No. 11/335,249, filed Jan. 19, 2006, Grilliot et al.
U.S. Appl. No. 11/418,616, filed May 5, 2005, Grilliot et al.

* cited by examiner

*Primary Examiner*—Katherine Moran
(74) *Attorney, Agent, or Firm*—Wood, Phillips, Katz, Clark & Mortimer

(57) ABSTRACT

A protective glove for a firefighter or for an emergency worker has an outer shell, an intermediate liner providing a moisture barrier, and an inner liner providing a thermal barrier, the outer shall having an inspection port, which is openable and closeable and which when opened enables portions of the intermediate liner to be visually inspected through the inspection port, the outer shell having a flap, which is positionable between a position wherein the inspection port is closed by the flap and positions wherein the inspection port is opened, the protective glove having releasable fasteners, such as hook-and-loop fasteners, for releasably fastening the flap in the position wherein the inspection port is closed by the flap.

8 Claims, 3 Drawing Sheets

10
S1
S2
S3
S4
S
74
50
30
2
2
60
72
20

A
60
70
1B
1B
20

70
72

74
20

74
50
20
30
42
40
44
46

PROTECTIVE GLOVE HAVING INSPECTION PORT

TECHNICAL FIELD OF THE INVENTION

This invention pertains to a protective glove for a firefighter or for an emergency worker. This invention contemplates that an outer shell of the protective glove has an inspection port, which when opened enables a liner of the protective glove to be visually inspected through the inspection port.

BACKGROUND OF THE INVENTION

As disclosed in U.S. Pat. No. 5,655,222, it is known for a firefighter's garment to have an inspection port, which when opened enables a liner of the firefighter's garment to be visually inspected. This patent teaches in column 2, lines 28 through 30, that "[w]hile the invention is discussed with reference to the coat of FIG. 1, it must be noted that it can be practiced in other garments such as overpants."

U.S. Pat. No. 4,817,210 discloses a protective coat of related interest. U.S. Pat. No. 5,090,058 discloses a jacket of related interest. U.S. Pat. No. 5,884,332 discloses a garment, either a jacket or trousers, of related interest.

SUMMARY OF THE INVENTION

This invention provides, for a firefighter or for an emergency worker, a protective glove having an outer shell and a liner, which is an intermediate liner if the protective glove also has an inner liner. The outer shell has an inspection port, which is openable and closeable. When opened, the inspection port enables portions of the liner to be visually inspected through the inspection port.

Preferably, the outer shell has a flap, which is positionable between a position wherein the inspection port is closed by the flap and positions wherein the inspection port is opened, and the outer shell has means for releasably fastening the flap in the position wherein the inspection port is closed by the flap. Preferably, the fastening means comprise hook-and-loop fastening means, although other fastening means, such as a series of snap fasteners or a zipper, can be alternatively used.

DETAILED DESCRIPTION OF THE ILLUSTRATED EMBODIMENT

Figure 1:
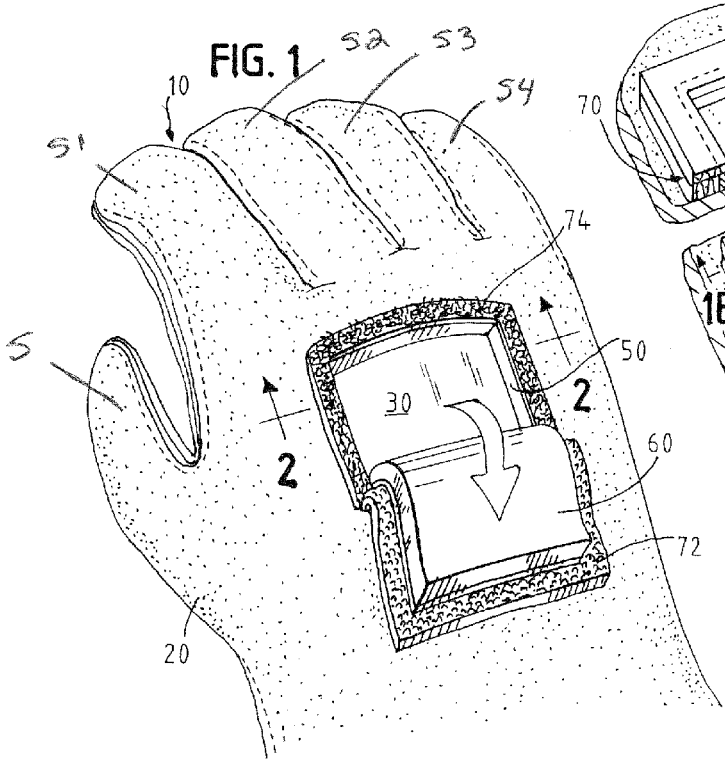
FIG. 1 is a pictorial view of a protective glove, as seen from its back face, whereby to illustrate that an outer shell of the protective glove has a flap, which is illustrated an a position wherein an inspection port of the outer shell is opened so as to enable an intermediate liner of the protective glove to be visually inspected.

As illustrated, a protective glove 10 for a firefighter or for an emergency worker is similar to protective gloves known heretofore in having an outer shell 20, an intermediate liner 30 providing a moisture barrier, that blocks the passage of liquid, and an inner liner 40 providing a thermal barrier. Each of the outer shell 20, intermediate liner 30, and inner liner 40 defines separate sheaths S, S1, S2, S3, S4 for separate fingers and a thumb on a wearer's hand. As illustrated, the outer shell 20 is made from leather, such as elkhide. Alternatively, the outer shell 20 is made from a suitable fabric, such as Kevlar™ fabric or Nomex™ fabric. As illustrated, the intermediate liner 30 is a separate liner made from a suitable material, such as neoprene. Alternatively, the intermediate liner 30 is bonded to the inner liner 40. As illustrated, the inner liner 40 comprises an outer, fabric layer 42, an inner, fabric later 44, and insulative material 46, such as felt, between the fabric layers 42, 44, which are quilted.

Figure 1A:
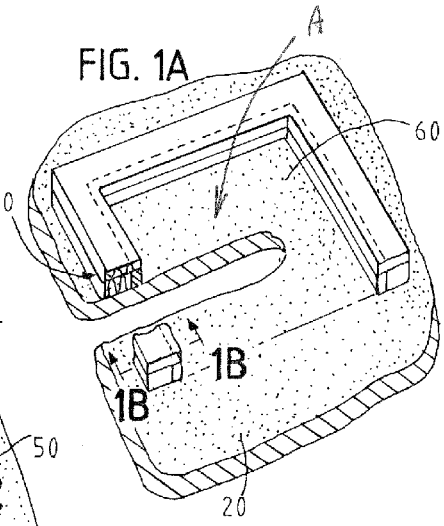
FIG. 1A is a similar view, except that the flap is illustrated in a position wherein the flap closes the inspection port.
Figure 1B:
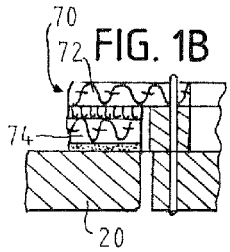
FIG. 1B is a sectional view, as taken along line 1B-1B in FIG. 1, in a direction indicated by arrows.
Figure 2:
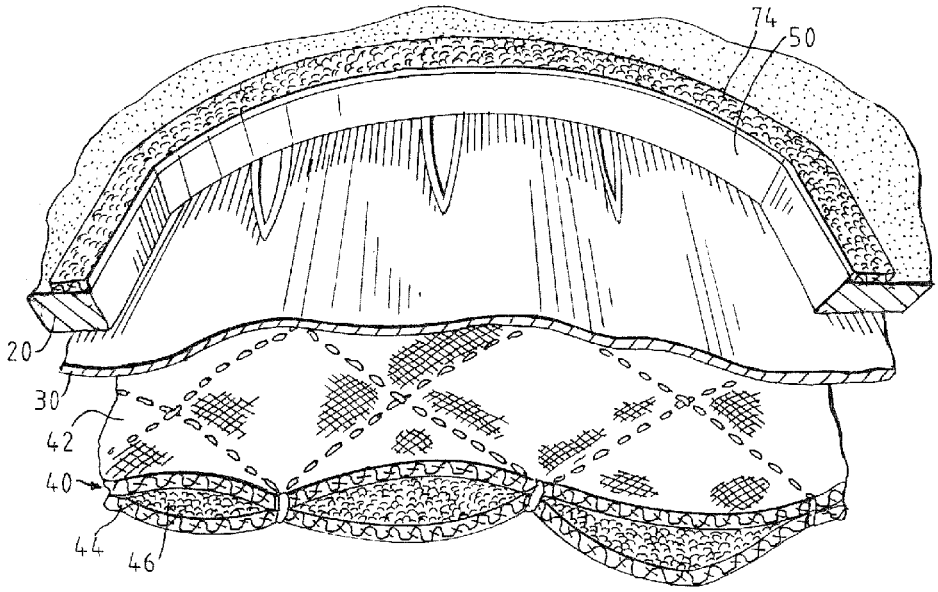
FIG. 2 is a sectional view, as taken along line 2-2 in FIG. 1, in a direction indicated by arrows.
Figure 3:
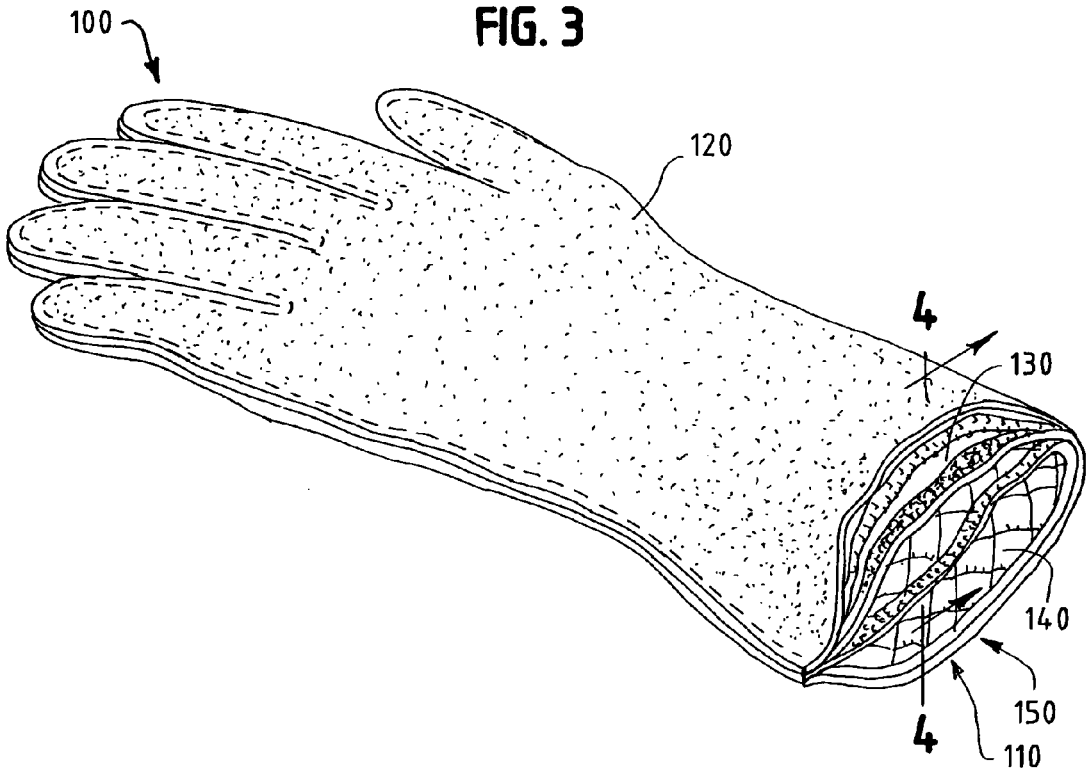
FIG. 3 is a pictorial view of a protective glove, as seen from its back face, whereby to illustrate that, along a margin of its open end, the protective glove has an inspection port, which when opened enables portions of an intermediate liner and portions of an inner liner of the protective glove to be visually inspected.
Figure 4:
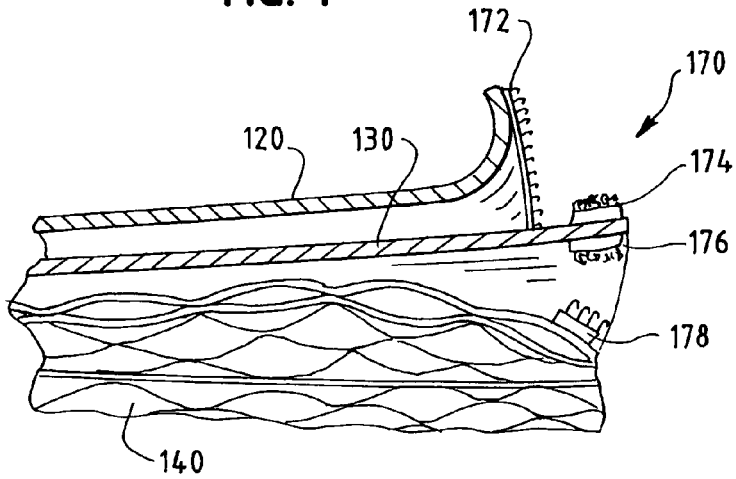
FIG. 4 is a sectional view, as taken along line 4-4 in FIG. 3, in a direction indicated by arrows.
Figure 5:
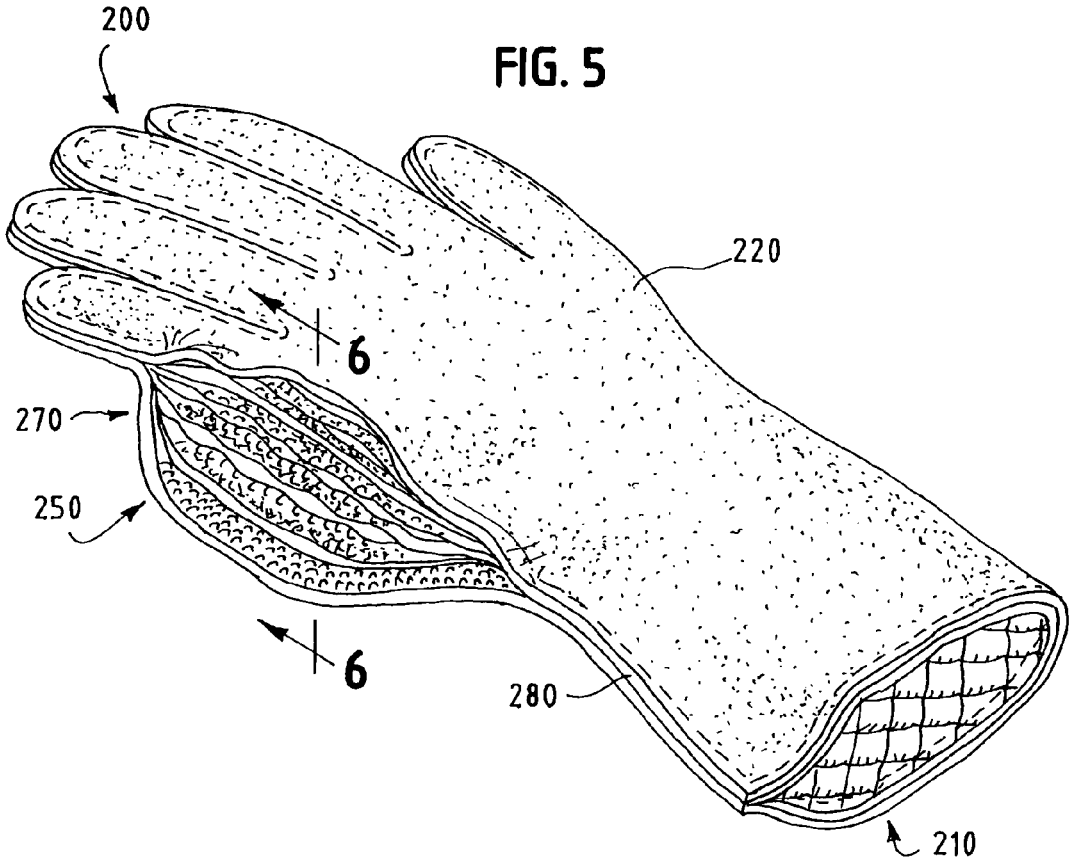
FIG. 5 is a pictorial view of a protective glove, as seen from its back face, whereby to illustrate that, along a n edge seam, the protective glove has an inspection port, which when opened enables portions of an intermediate liner and portions of an inner liner of the protective glove to be visually inspected.
Figure 6:
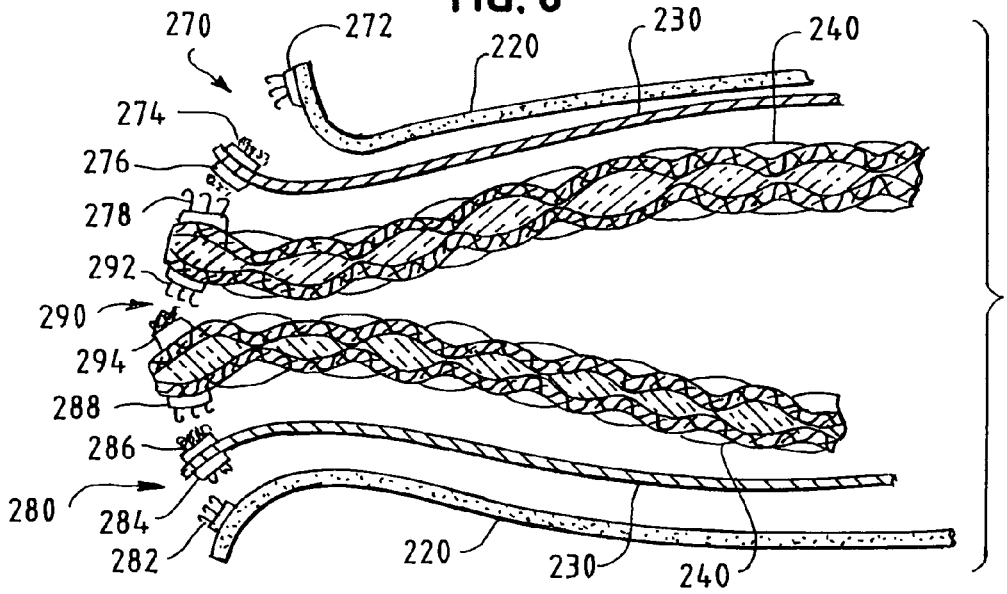
FIG. 6 is a sectional view as taken along line 6-6 in FIG. 5, in a direction indicated by arrows.

As contemplated by this invention, the outer shell 20 has an inspection port 50, which is openable and closeable and which when opened enables a substantial area A on the outer surface of the intermediate liner 30 that is exposed to be visually inspected through the inspection port 50, and a flap 60, which is positionable between a position (see FIG. 1A) wherein the inspection port 50 is closed by the flap 60 and positions (see, e.g., FIG. 1) wherein the inspection port 50 is opened. Rather than a unitary flap, as illustrated, a sewn-on or glued-on flap can be alternatively provided.

Furthermore, the protective glove 10 has means for releasably fastening the flap 60 in the position wherein the inspection port 50 is closed by the flap 60. As illustrated, the fastening means comprise complementary hook-and-loop fasteners 70 comprising a hook-faced tape 72, which is sewn along and to the margin of the flap 60, and comprising a loop-faced tape 74, which is sewn along and to the margin of the inspection port 50. The respective tapes 72, 74, can be alternatively glued along and to the respective margins. Rather than complementary hook-and-loop fasteners, other releasable fastening means, such as a series of snap fasteners or a zipper, can be alternatively used.

The invention claimed is:

1. For a firefighter or for an emergency worker, a protective glove having an outer shell and a separate moisture barrier liner within the outer shell, with both of the outer shell and moisture barrier liner defining separate sheaths for separate fingers and a thumb on a wearer's hand, the outer shell having an inspection port, which is openable and closeable and which when opened enables portions of the moisture barrier liner to be visually inspected through the inspection port, wherein the moisture barrier liner is made from a different material than the outer shell that blocks passage of liquid.

2. The protective glove of claim 1, further comprising a hook-and-loop fastener located to selectively retain the inspection port in a closed position.

3. The protective glove according to claim 1 wherein the moisture barrier liner has inner and outer surfaces and with the inspection port opened, a substantial area of the outer surface of the moisture barrier liner is exposed for inspection.

4. For a firefighter or for an emergency worker, a protective glove having an outer shell and a separate moisture barrier liner within the outer shell, with both of the outer shell and moisture barrier liner defining separate sheaths for separate fingers and a thumb on a wearer's hand, the moisture barrier liner being made from a different material than the outer shell that blocks passage of liquid, the outer shell having an inspection port, which is openable and closeable and which when opened enables portions of the moisture barrier liner to be visually inspected through the inspection port, the outer shell having a flap, which is positionable between a position wherein the inspection port is closed by the flap and positions wherein the inspection port is opened, the protective glove having means for releasably fastening the flap in the position wherein the inspection port is closed by the flap.

5. The protective glove of claim 4, wherein the fastening means comprise hook-and-loop fastening means.

6. For a firefighter or for an emergency worker, a protective glove having an outer shell, a separate, intermediate, moisture barrier liner within the outer shell, and an inner, thermal barrier liner the moisture barrier liner being made from a different material than the outer shell that blocks passage of liquid, all of the outer shell, moisture barrier liner, and thermal barrier liner defining separate sheaths for separate fingers and a thumb on a wearer's hand, the outer shell having an inspection port, which is openable and closeable and which when opened enables portions of the moisture barrier liner to be visually inspected through the inspection port, the outer shell having a flap, which is positionable between a position wherein the inspection port is closed by the flap and positions wherein the inspection port is opened, the protective glove having means for releasably fastening the flap in the position wherein the inspection port is closed by the flap.

7. The protective glove of claim 6, wherein the fastening means comprise hook-and-loop fastening means.

8. The protective glove as recited in any of claims 1-7 wherein the moisture barrier liner comprises neoprene.

* * * * *